United States Patent [19]

Setterholm et al.

[11] Patent Number: 4,702,870

[45] Date of Patent: Oct. 27, 1987

[54] METHOD AND APPARATUS FOR FORMING THREE DIMENSIONAL STRUCTURAL COMPONENTS FROM WOOD FIBER

[75] Inventors: Vance C. Setterholm, Blue Mounds; John F. Hunt, Madison, both of Wis.

[73] Assignee: The United States of America as represented by the Secretary of Agriculture, Washington, D.C.

[21] Appl. No.: 864,920

[22] Filed: May 20, 1986

[51] Int. Cl.[4] ..... B28B 1/52

[52] U.S. Cl. ..... 264/87; 162/223; 162/226; 162/227; 162/296; 162/382; 264/86; 264/517; 264/518; 264/120; 264/121; 264/313; 264/314; 425/80.1; 425/83.1; 425/84; 425/85; 425/DIG. 19; 425/DIG. 44; 425/DIG. 112; 425/DIG. 119

[58] Field of Search ..... 264/86, 87, 517, 518, 264/555, 571, 120, 121, 166, 313, 314; 425/84, 85, 80.1, 83.1, 405 R, 403, 447, 417, DIG. 112, DIG. 119; 249/65; 162/223, 224, 226, 227, 228, 230, 382, 296

[56] References Cited

U.S. PATENT DOCUMENTS

| | | | |
|---|---|---|---|
| 3,166,467 | 1/1965 | Reifers et al. | 264/87 |
| 3,354,248 | 11/1967 | Haas et al. | 264/120 |
| 3,449,207 | 6/1969 | Modersohn | 264/86 |
| 4,162,877 | 7/1979 | Nyberg | 425/84 |
| 4,388,263 | 6/1983 | Prunty | 264/257 |

*Primary Examiner*—Jan H. Silbaugh
*Assistant Examiner*—Mary Lynn Fertig
*Attorney, Agent, or Firm*—M. Howard Silverstein; David G. McConnell

[57] ABSTRACT

Methods and apparatus for producing three-dimensional structural members having one flat side from wood fibers utilizing flow deposition of the fibers onto a support. The support includes resilient deformable mold inserts. The mold inserts are formed of silicone rubber and may be blocks of the material, or may be a membrane which can be inflated to form the mold inserts. Pressing is done with a force normal to the support, and the mold inserts create response forces at varying directions to thus shape and hold the three-dimensional finished part. Heat drying also may be used.

35 Claims, 14 Drawing Figures

METHOD AND APPARATUS FOR FORMING THREE DIMENSIONAL STRUCTURAL COMPONENTS FROM WOOD FIBER

FIELD OF THE INVENTION

This invention relates to the production of structural components such as texturized panels for use in construction, using wood fibers of any kind as the raw material.

BACKGROUND OF THE INVENTION

The present invention pertains to forest products and particularly to the use of wood fibers.

Trees in the USA are of two general types for commercial purposes, hardwoods and softwoods. The softwoods are well utilized for the manufacture of newsprint, paper and the like paper products. Hardwoods, in the larger trees, are well utilized for the production of lumber.

However, the hardwood category also includes large numbers of relatively small trees, trees that are deformed or are otherwise not well shaped to produce commercial sizes and quantities of lumber, and the relatively larger as well as the smaller limbs of the larger hardwood trees which are not utilizable for lumber. The present invention is directed towards utilization of this resource.

That is, softwood production is well spoken for and most of the hardwood production is spoken for. It is the part of the hardwood production which is not otherwise usable at present which is usable in accordance with the invention to produce structural material such as panels with texturized surfaces and other objects of a particular category.

The prior art has been aware of certain problems in the use of hardwood fiber in methods such as the present invention that involve pressing of the fibers into products. Hardwoods tend to have short and thick walled fibers. These short thick walled fibers, when used in conventional processes of the same general category as the present invention and in paper making, tend to bend to each other only poorly, and, especially important as to paper, tend to exhibit poor tear strength and an abudance of natural and generated fine material that causes drainage problems resulting in low wet web strength. In the present state of the art, hardwood pulps are used primarily only as a filler and as a means to provide smoother surfaces on paper for printing.

Because of these problems, utilization of hardwoods of lower than lumber quality as set forth above has not occurred. This results in a good deal of waste of these lower quality hardwoods resulting in added pressure on softwood production.

SUMMARY OF THE INVENTION

The present invention includes a porous support member or which are mounted several embodiments of resilient mold inserts. The support member may be a screen, the screen can move in order to provide a continuous process, and various different materials can be used as the porous support.

After production of the wood fibers in the convertional manner, they are made into a thin slurry, that is, a high water-to-fiber ratio and then are deposited onto the molds using the flow through forming method to deposit the fibers on top of the molds. The water or other carrier fluid of course flows through the fiber mat and out the porous support.

The next step comprises the exertion of a normal force on the loose mat, which causes it to become more dense and drives out most of the water. Finally, the normal force is maintained on the mat to densify it even further and to extract the remainder of the water. Optionally, heat can be applied at this stage of the process.

Another advantage of the invention in this regard is that it is significantly less expensive to extract water in flow-through deposition of fiber using pressure rather than using heat. The invention can use heat but only in the last step. Most of the remaining water used for the flow-through deposition of the fiber is removed using the normal pressure on the mat.

The mold inserts of the invention take two basic forms, each with several variations. These are solid blocks formed of resilient material, and an inflatable formed membrane made of the same types of resilient material as the solid blocks.

In use of the membranes, the mold is first closed to a predetermined degree, the formed membrane is inflated, and the water flows out or is driven off. The air pressure on the formed membrane is held until the structural article is cured or set.

ADVANTAGES OF THE INVENTION

The present invention permits the use of all sorts of wood fibers and combinations thereof ranging from 100 percent softwood fiber up through all mixtures to 100 percent hardwood fibers. The fibers can be taken from any sort of secondary quality raw materials, such as small trees, misformed trees, limbs, and the like. This is an important advantage for the present invention in regard to efficient utilization of the wood resources currently available.

The present invention uses a combination of steps, techniques, and materials, all of which are in and of themselves individually known. This yields the advantage of use of all state-of-the-art and proven techniques and materials. However, these procedures and materials are combined in unique manners to produce advantages heretofore unknown in these arts.

The invention concerns itself with the production of a certain class or definition of three-dimensional objects. These are characterized by having one flat surface and having the opposite surface including three-dimensional features, such as webs and flanges, which extend away from the plane of the flat side. Formation of such articles in the prior art has required the use of forces applied in more than one direction. The present invention permits the production of this category of three-dimensional objects using only one force normal to the flat side. The forces necessary to generate the three-dimensional shapes on the other side are created by, in a first embodiment, the use of deformable mold inserts which by themselves, upon application of the normal force, produce reaction forces which create the formed shapes on the side opposite the flat side. In a second embodiment, the inflatable formed membrane molds operate in a similar manner by using only fluid pressure, preferably air, on the underside of the membrane to create the formed shapes on the side of the structural member being produced opposite the flat side thereof.

This part of the invention produces an enormous advantage in that it is much less expensive to make molds that press in one direction. The resiliency of the mold inserts permits the use of smaller pressure forces overall which in and of itself effects further economic advantages for the invention method.

The invention method has great versatility. It can operate using a single mold, a plurality of molds, a process according to the invention can be made to operate continuously, batch processing is of course possible, the porous support can be a continuously moving belt or wheel or the like, and many other variations are within the teaching of the invention method.

An important aspect of the overall system of the invention is the use of the so-called press drying technique. This is a step wherein pressure and possibly also heat are applied to the product as the last step before it is finished to hold the fibers in place while they dry or cure, and to drive off the last of the water or other fiber carrier fluid used earlier to deposit the fibers. It is this step which is helpful in permitting the use of the otherwise difficult to work with hardwood fibers to make structural members in accordance with the invention.

The invention can be used to make structural panels in a wide range of thicknesses, ranging from 1/16 inch up to several inches in thickness. Products made in accordance with the invention can be used for containers, panels for home and other construction, and other applications which will present themselves to those skilled in these arts.

BRIEF DESCRIPTION OF THE DRAWINGS

The invention will be better understood with reference to the accompanying drawings, also forming a part of this disclosure, wherein.

DETAILED DESCRIPTION OF THE PREFERRED EMBODIMENTS

FIGS. 1–8 illustrates the invention as applied to a two-step or two-stage process. As will be clear to those skilled in the art, the teachings of the invention are equally applicable to multiple- or even single-step processes to produce structural members. This will be dictated by the economic constraints and the physical parameters concerning the particular project.

Figure 1:
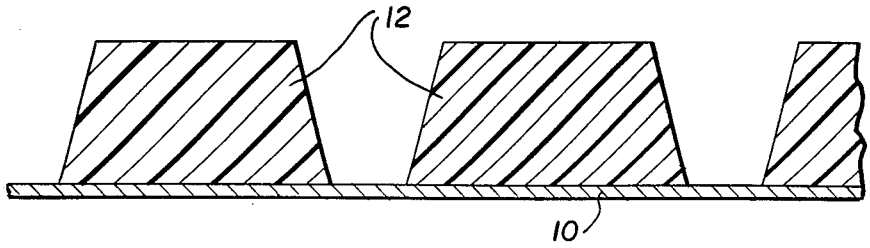
FIGS. 1–8 are a sequence of schematic drawings illustrating a method of the invention according to a first embodiment thereof.

Referring now to FIG. 1, the invention utilizes a porous carrier 10 which may be in the form of a metal screen, a belt, a wheel, a roller, or the like. This porous carrier can be stationary for batch type processing or can be a moving member so as to be part of a continuous production process.

Suitably fixed to the porous carrier 10 are mold inserts 12 which will define, by the spaces between them, the configuration of the structural members to be produced in accordance with the invention. The inserts are essentially evenly distributed throughout the surface of carrier 10.

Figure 2:
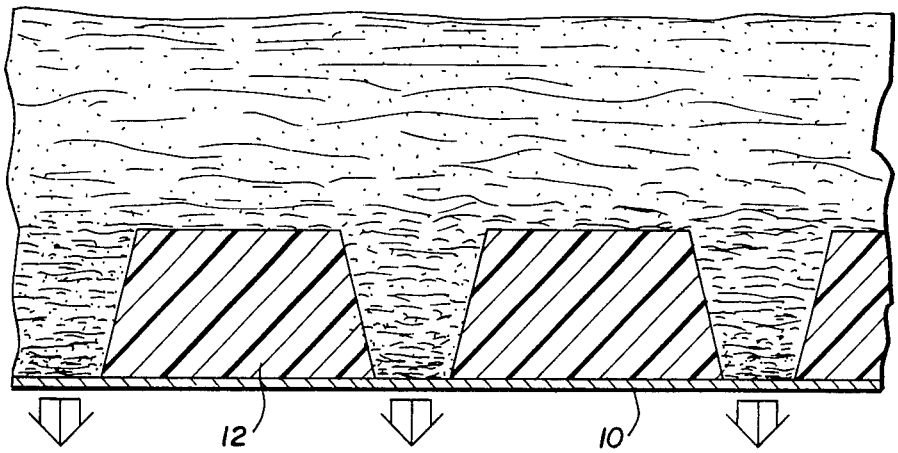

FIG. 2 illustrates the flow-through deposition of previously prepared wood fibers onto the porous support 10 and between and on top of mold inserts 12. The transporting fluid can be water, air, foam or other materials. Flow-through deposition of fibers is a well known technology, and it is an advantage of the invention that it uses this developed technology. As the fibers are deposited, and for a time thereafter, an initial densification of the fiber mat as well as exiting of most of the water or other carrier fluid will occur naturally by gravity and/or by pressure differential. The pressure differential may be created by a vacuum below the porous support 10 or increased ambient pressure above the deposited fibers.

Figure 3:
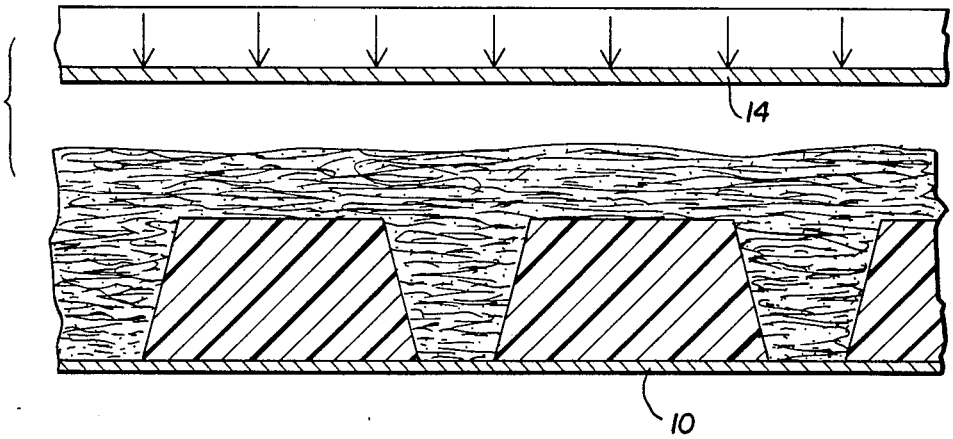

FIG. 3 shows the condition after the gravity and/or pressure differential step, the fibers are now more or less uniformly distributed over the mold surfaces. At this stage, these loosely distributed fibers as shown in FIG. 3 have very little structural integrity.

Figure 4:
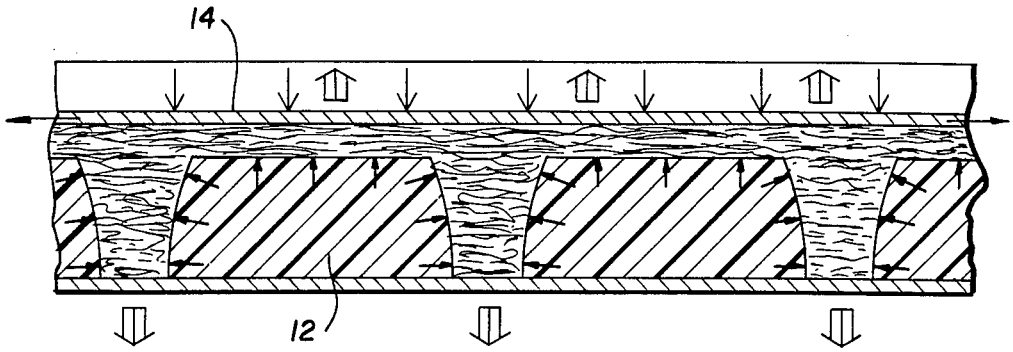

FIG. 4 shows a pressing step using a moving top mold 14. This pressing step of FIG. 4 is an important part of the invention process. Note that the mold inserts 12 are deformed slightly in response to the normal pressure applied by the moving mold 14. Note further, as indicated by the plurality of arrows on the mold inserts, that their response is not solely parallel to the normal force exerted by the moving mold 14. This is due to the particular nature of the resilient materials utilized to fabricate the mold inserts 12.

In addition, the pressing step of FIG. 4 removes additional water or other carrier fluid. The top mold 14 is also porous and the carrier fluid exits both through the porous carrier 10 as before and also through the top presser mold 14. All of this exiting of the carrier fluid is indicated by the three-line arrows on FIG. 4. The three-line arrows are used elsewhere in the FIGURES to indicate exiting of carrier fluid in other steps.

Thus, as is clear from FIG. 4, the normal force applied at the top mold 14 produces three-dimensional densification of the part due to the resiliency of the mold inserts 12.

The force applied in this pressing of FIG. 4 is sufficient to give the part 16 sufficient structural strength that it may be removed form the mold and transferred to a second mold for the second stage of this embodiment of the invention.

The above explanation also makes it clear that the invention can be used to make only a certain category of three-dimensional objects. Objects suitable for use with the invention are characterized by having a flat surface on one side for cooperation with the top mold 14, and webs or other configurations which may extend normal or generally normal to the flat surface. The limitation here is that they lend themselves to formation utilizing resilient rubber-like mold inserts 12.

The term "three-dimensional object" as used in the specification and claims herein shall be understood to mean an object as defined above. Overall, another way of looking at the definition is to consider that the object is one which can be formed utilizing a single normal force and resilient molds to produce forces at various angles to the normal pressing force.

Continuing the explanation of the example herein using a two-stage process, the intermediate formed three-dimensional object 16 is new transferred to a second mold comprising a second porous carrier 10A on which are mounted a second set of resilient mold insert members 12A, which cooperate with a second top press 14A. The parts 10, 12 and 14 in FIGS. 1–4 are similar and functionally equivalent to the parts 10A, 12A and 14A of FIGS. 5–8, the dimensions and configurations being slightly different in order to produce the final finished product as described in greater detail below.

Figure 5:
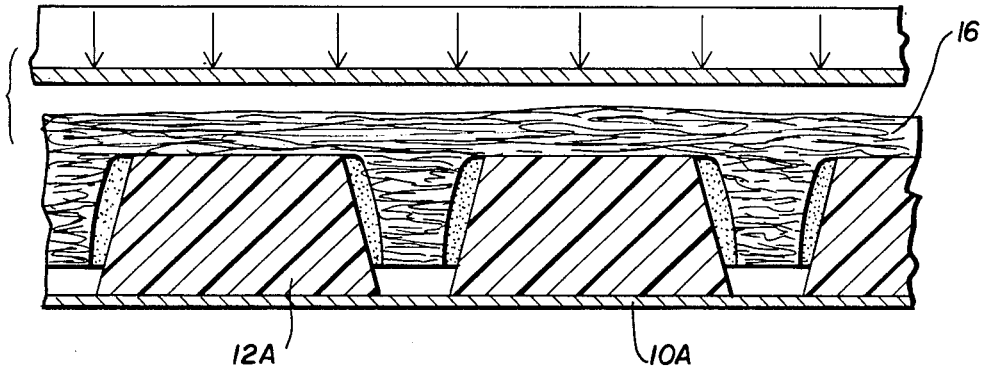

FIG. 5 shows the simple laying in of the partially completed object 16 in the second set of molds 10A and 12A. Alignment is important in order to get proper registry and accurate formation of the structural features on the side opposite the flat side. This is the point illustrated by FIG. 5.

Figure 6:
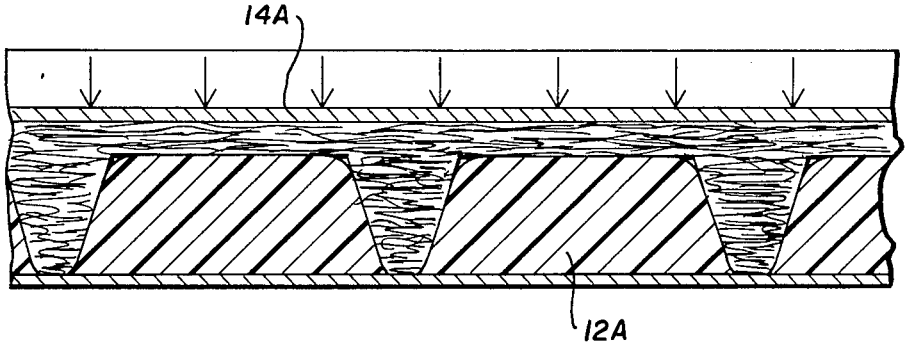

A second relatively light pressing is applied after the part is properly aligned as shown in FIG. 6. The second set of mold inserts 12A are designed so as to complete the pressing to produce the final finished product 18, see FIG. 8.

Figure 7:
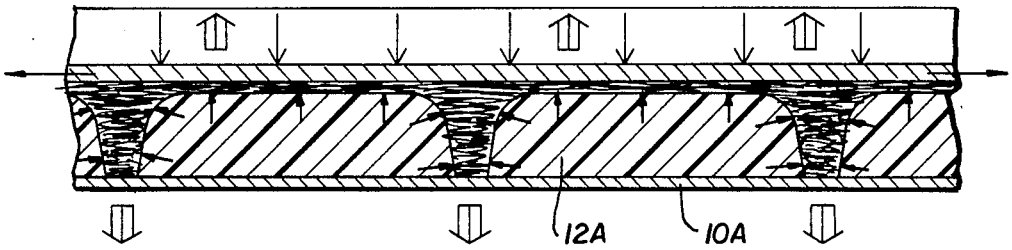

FIGS. 6 and 7 show the application of the second normal force, further densification of the intermediate product 16 into the finished product 18, and further exiting of water or other carrier fluid through the porous carrier 10A and the porous press 14A. Note the change in size of the mold inserts 12A between their normal or rest condition in FIGS. 6 and 8 and their compressed condition in FIG. 7. This quality of the rubber-like resilient mold inserts 12A is that which produces the three-dimensional forming forces generated from solely a normal force.

It is this utilization of a normal force which produces important advantages for the invention. These advantages include energy savings in that a normal force is relatively easy to apply, and further, that the use of energy is less than would be required in other systems wherein forces must be applied in multiple directions to the mat to produce the finished part.

FIG. 7 also illustrates the final step in this embodiment of the invention. By simply holding the top pressing mold 14A in place for a predetermined length of time which is set by the nature of the part 18 and of the wood fibers and the like used, the final curing or drying of the fiber structure can be accomplished at this last step of FIG. 7, and heat may also be applied at this point. This can be done in ways well known to those skilled in these arts, by providing heating means in conjunction with one or both of the porous carriers 10 and 10A and/or the top pressing molds 14 or 14A.

Thus, it has been seen that a process of the character described has been provided. The example of the two-stage process of FIGS. 1–8 utilizing a first molding of FIGS. 1–4 and a second molding of FIGS. 5–7 is not limiting, it could all be done in a single stage as in FIGS. 1–4 or in further multiple stages in the event that the part 18 is particularly complex in nature or requires further densification. In the event of a one-stage process using the apparatus of FIG. 4, the completion of densification may be accomplished simply by holding pressing mold 14 in place for a predetermined length of time which is set by the nature of part 16 and the wood fibers and the like used therein. In such a one-step process, final curing or drying of the fiber structure is accomplished as the last step of FIG. 4, and heat also may be applied at this point.

In the same manner, one- or two-stage processing may be accomplished in the second embodiment of FIGS. 9–11, as described below. Technology exists to automate the processes of the invention so that the structural parts can be produced in continuous form or as individual elements. Other variations and equivalents will present themselves to those skilled in these arts.

Figure 8:
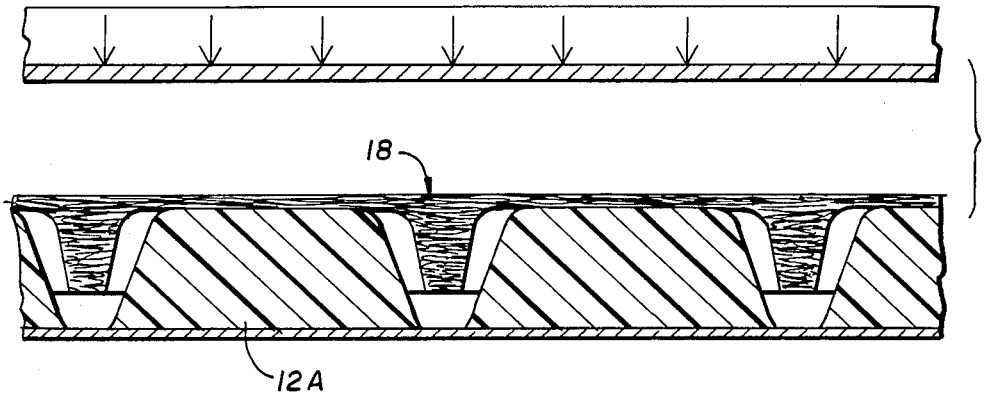
Figure 9:
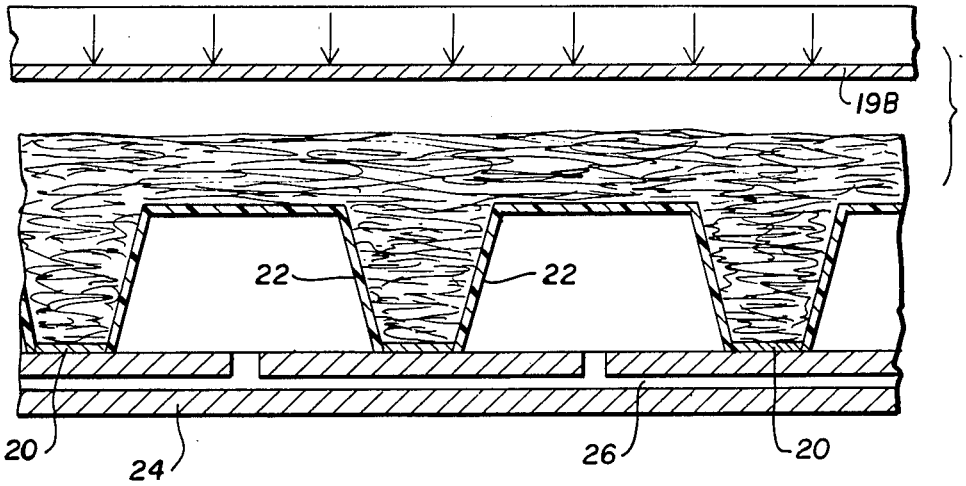
FIGS. 9–11 are a sequence of schematic drawings similar to FIGS. 1–8 illustrating other embodiments of the invention.
Figure 10:
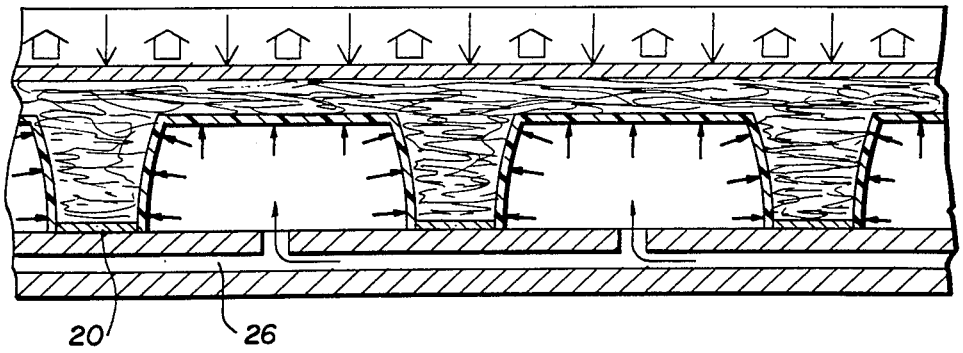
Figure 11:
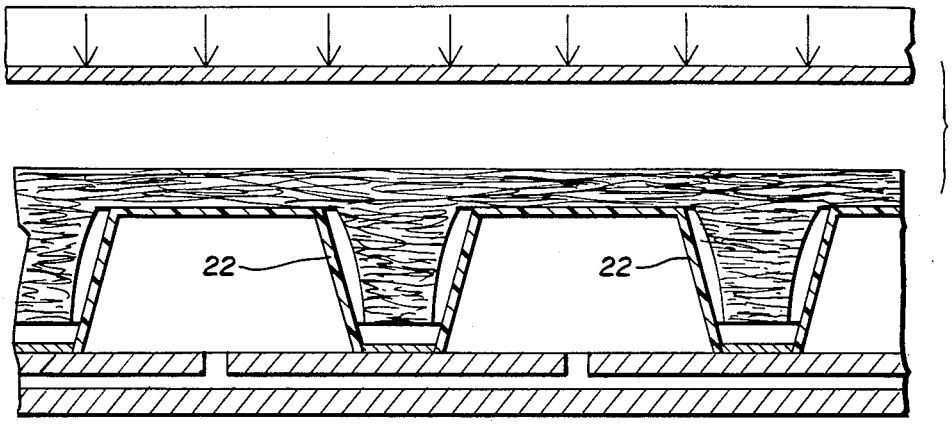

Referring now to FIGS. 9, 10, and 11, further embodiments of the invention are disclosed. The embodiments of FIGS. 9, 10, and 11 utilize an inflatable, flexible membrane which is preferable made of the same silicone rubber as the inserts 12 and 12A of FIGS. 1–8. The membrane 22 is secured to the bottom plate 24 by a plurality of framing members 20 which form a network around the erect mold insert portions of the membrane 22. An air or other pressurized fluid supply network 26 is provided, and openings are provided in the passageways 26 to inflate the membranes in the vicinity between the hold down strips or securing means 20. A top pressing mold 14B, analogous to the parts 14 and 14A of FIGS. 1–8, is also provided.

FIG. 10 is analogous to FIG. 7 as described above. Instead of the three dimensional force being generated internally within the material of blocks 12 or 12A, the air pressure under the active parts of the membrane 22 serves this function. The arrows pointing upwardly from the presser 14B indicate that a vacuum assist can be provided to remove the last of the water or other carrier fluid used to deposit the fibers around the mold inserts. This vacuum assist can also be utilized in the first embodiments of FIGS. 1–8.

FIG. 11 is analogous to FIG. 8 and shows the finished product. The mold insert sections of the membrane 22 are formed of sufficiently stiff material that they will stand erect as shown in FIG. 11 even with the inflating pressure relieved.

When heat is applied as in FIG. 10, after all of the liquid water has been removed, the vacuum system will withdraw steam from the article being made and from the space within the mold.

The use of solid mold inserts as in FIGS. 1–8 is deemed preferable where the overall thickness of the article being manufactured is relatively thinner. The inflatable membrane of FIGS. 9, 10, and 11 is preferred where the overall thickness of the part being manufactured is relatively thicker. However, these considerations are not definitive, and there is substantial overlap as to the parts being made. Other factors also go into the choice of which embodiments of the invention to use, such as the kind of wood fibers, the density of the final product, and like factors known to those skilled in these arts.

The embodiments of FIGS. 9, 10, and 11 can be used for a second stage of a process, that is, analogous to FIGS. 6–8. However, it can as well be used for a single stage process, that is, such as FIGS. 1–4. In that event, where large quantities of the carrier fluid, which is usually water, need to be removed, heat, suction, and gravity wherein the water will flow sideways, that is perpendicular to the paper of the drawings, will advantageously be used and will come into effect. That is, the water, where the FIG. 9–11 embodiment is used for a first forming, will simply flow by gravity out the sides of the mold, rather than through the mold as in FIGS. 1–4.

Figure 12:
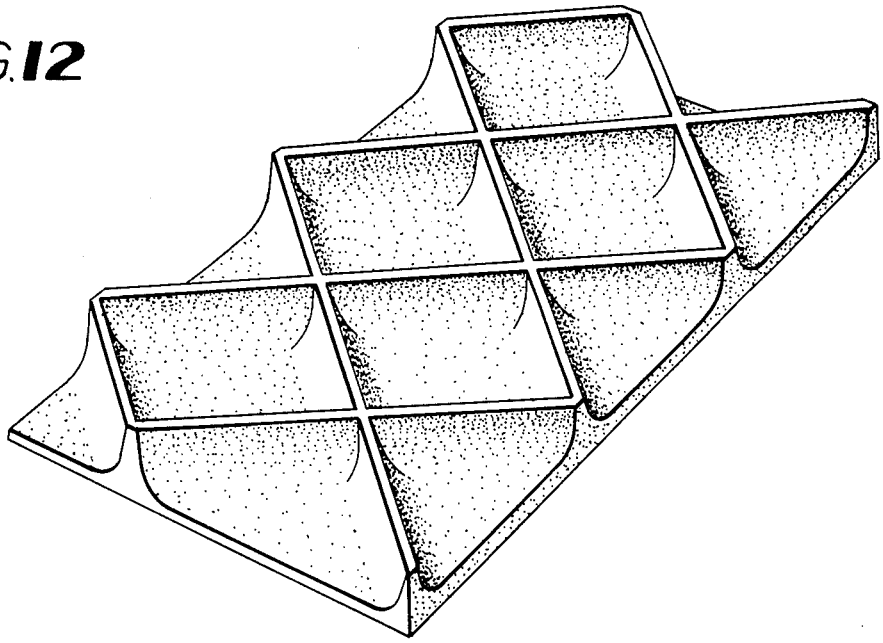
FIGS. 12 and 13 are perspective views of products formed in accordance with the invention.
Figure 13:
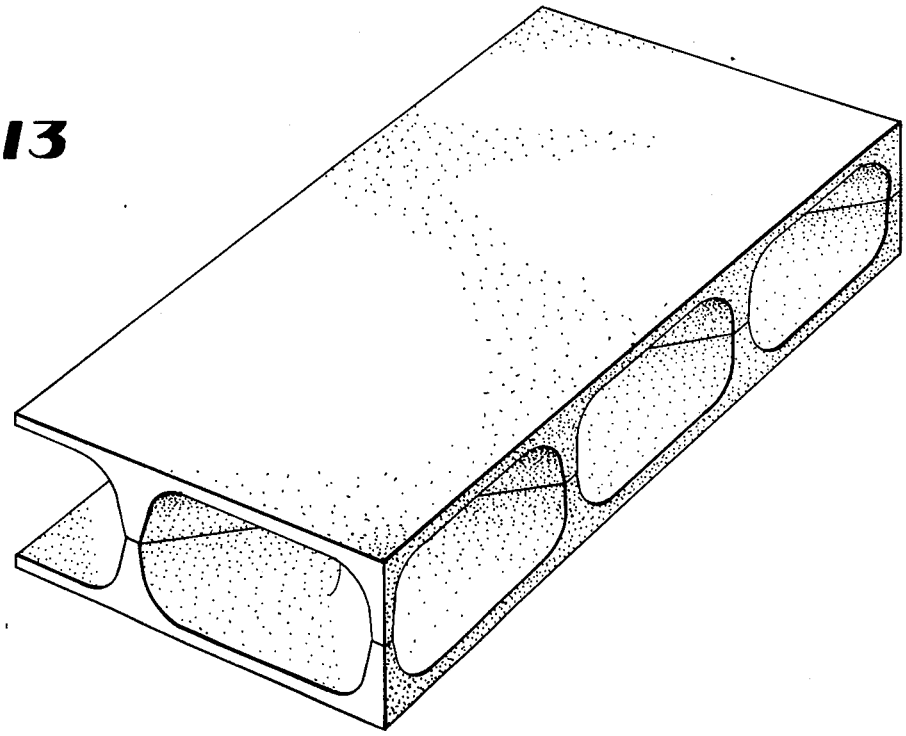

FIG. 12 illustrates a waffle-like panel type material which could be produced in accordance with the teachings of any of the embodiments of FIG. 1–11. FIG. 13 is a companion crawing showing two of the panels of FIG. 12 joined together to make a honeycomb type of panel material having two external smooth sides. Other variations will, of course, present themselves to those skilled in these arts.

Figure 14:
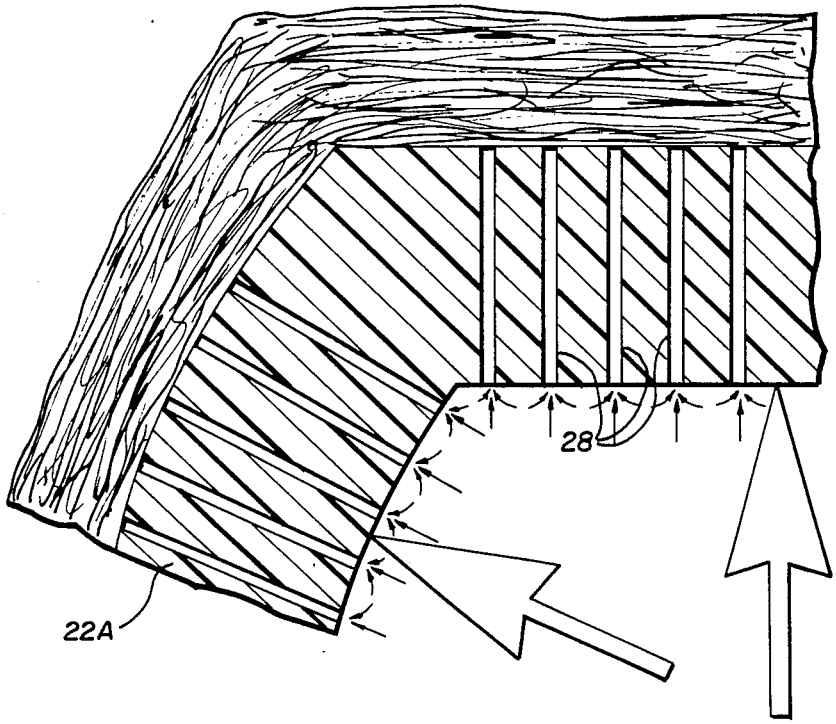
FIG. 14 is an enlarged view of a detail according to another embodiment of the invention.

FIG. 14 shows an enlarged detailed view of another variation wherein the membrane 22A is formed with a plurality of small operings 28 which permit the pressurizing fluid, which usually is air or possibly steam, to pass through the membrane and thence through the product. The air assists in driving off the carrier fluid, usually water, used to deposit the mats of wood fibers in the mold. This also can be used in conjunction with the vacuum assint of FIG. 10 to drive the carrier fluid off even more quickly.

The double paneled structure of FIG. 14 car to used to make structural wall panels, insulating panels by filing the internal spaces with fiberglas or other insulating material, and for floors, doors, and for other such members.

The invention can also be used in combination with resins mixed in with the wood fibers. In such case, the heat would serve the additional function of setting up the final product by curing such resins. In that case, it may be necessary to hold the pressure on the part, as in FIGS. 7 and 10, for sufficient periods of time to permit the curing of the resin. However, depending upon the particular resin, heat may not be required at all.

Thus, it can be seen that both basic variations of the invention include "mold inserts", and that term as used in the specification and claims herein shall be understood to include the solid or substantially solid blocks of resilient material of FIGS. 1–8, as well as the inflatable membrances which insert themselves into the mold space of the second embodiments of FIGS. 9–11.

The following is a list of specific parameters which resulted from experimental work which has been done during the development of the invention.

1. Fibers—mixtures ranging from 100% hardwood up through 100% softwood and any mixture therebetween.

2. Initial fiber to fluid mixture: 0.09 to 1.0% by weight of fiber to water. Adjustments will be needed when using other carrier fluids.

3. Top press molds and bottom porous carriers bronze or stainless steel screening. These are the only materials that have been tested, other materials and other shapes of materials are of course utilizable.

4. Molds inserts 12 and 12A—Silastic HS silicone rubber by Dow Corning, secured in place by Dow Corning Silastic 736 adhesive, or any other equivalent securing method.

5. First press on the molds of FIGS. 1–4—25 to 100 PSI.

6. Second press on the second mold of the FIGS. 5–7—5 to 80 PSI.

7. Drying temperature —212° to about 400° Fahrenheit with heat going to one or both of the sides of the finished product. The heat cannot be so great as to cause temperatures that would degrade the wood fibers or the rubber blocks or diaphragms. Cold pressing can also be used.

8. Screens—It is possible to use the platen itself in the press 14A of FIG. 7. It is also possible to substitute a screen for the pressure press and to press against the screen. In such a case, a 150 mesh stainless steel screen or a bronze screen on the order of 88–92 mesh can be used.

9. Air pressure in FIGS. 9–11—From 5 psi to 40 psi, although it could be 40 of 2,000 psi, dependent upon the product to be produced and other parameters.

The invertion process is not to be confused with the paper making arts. The invention produces structural elements, and structural elements of a particular three-dimensional category. Paper making presents substantially different problems. There is no consideration when making paper of producing structural items having large thicknesses on the order of multiple inches nor is there any such problem when making paper having to do with webs which extend normal to the main surfaces of the paper and which themselves have substantial thickness. Thus, while the individual steps utilized in the invention may be known in other arts, the overall combination to produce parts of the particular three-dimensional category as is herein contemplated is not known.

While the invention has been described in detail above, it is to be understood that this is by way of example only and the protection granted is to be limited solely by the spirit of the invention and the scope of the following claims.

We claim:

1. A method of making a three-dimensional object of wood fiber, said object comprising a substantially flat side and webs extending from the object at an angle to the flat side from the side thereof, opposite said flat side, comprising the steps of providing a first porous support, providing first mold inserts on said support, forming said mold inserts of resilient material, depositing wood fiber on said suppor around and on top of said mold inserts using a carrier fluid technique wherein said fibers are carried in a fluid and the fluid flows through the mat of fibers deposited on the mold inserts, permitting the mat of fibers to settle and the fluid to exit through the pores of said support due to gravity and/or pressure differential pressing the mat on the mold inserts and the support using a flat surfaced press member by applying a pressing force normal to said flat surfaced press member to compress said mold inserts and to squeeze out remaining carrier fluid used in said flow deposition stop, said compresser of said mold inserts causing said mold inserts to generate three-dimensional forming forces, thereby causing densification of said mat in directions parallel to and other than parallel to said pressing force, and removing the compressed object from said support and from said mold inserts.

2. The method of claim 1, and providing at least a second stage of compression using at least a second support and second mold inserts to form and finish said object after it is removed from said first support and said first mold inserts.

3. The method of claim 1, and providing a porous press member so that fluid can exit there through during said pressing step.

4. The method of claim 1, wherein said porous support comprises a metal screen.

5. The method of claim 1, and the step of simultaneously holding said press member in place on the compressed object and on the mold inserts and applying heat thereto, whereby said object is formed using a press drying technique.

6. The method of claim 5, and applying said heat at a temperature in the range of about 212° F. to about 400° F.

7. The method of claim 1, and providing a moving support so that production of said wood fiber objects proceeds certinuously.

8. The method of claim 1, wherein said fluid is water, and providing said wood fibers in an amount in the range of about 0.09 to about 1.0 percent of fiber to water.

9. The method of claim 1, wherein the step of pressing said mat comprises using pressure in the range of about 25 to about 100 psi.

10. The method of claim 1, wherein said step of forming said mold inserts comprises making said mold inserts of blocks of silicone rubber.

11. The method of claim 1, wherein said step of forming said mold inserts comprises making said mold inserts from a membrane of said resilient material, and selectively inflating portions of said membrane to form said mold inserts.

12. The method of claim 1, wherein said object is a textured construction panel.

13. The method of claim 1, and providing said fibers substantially entirely of hardwood fibers.

14. The method of claim 1, wherein said webs extend at substantially a right angle to said flat side.

15. The method of claim 1, and the step of gluing said mold inserts to said support.

16. The method of claim 1, wherein the step of providing mold inserts on said porous support comprises spacing said mold inserts apart from each other on said porous support.

17. The method of claim 1, wherein the steps of forming said mold insert comprises forming said mold inserts of a membrane of said resilient material, and providing mold inserts on said support comprises securing said membrane to said support using a pattern of securing means to form a plurality of functionally separate mold inserts from said membrane.

18. Apparatus for making a three-dimensional object of wood fiber, said object comprising a substantially flat side and webs extending from the object at an angle to the flat side from the side thereof opposite said flat side, comprising first a porous support, first mold inserts on said support, said mold inserts being formed of resilient material, means for depositing wood fiber on said support around and on top of said mold inserts using a technique wherein said fibers are carried in a fluid and the fluid flows through the mat of fibers deposited on said mold inserts, a flat surfaced press member, means for pressing the mat onto the mold inserts and the support using said flat surfaced press member, and means for applying sufficient pressing force normal to said flat surface to deform said mold inserts and to squeeze out remaining fluid used in said flow deposition step, mold inserts configured to generate three-dimensional forming forces upon application of a solely normal force thereto, said mold insert deformation causing densification of said mat in directions parallel to and other than parallel to said pressing force.

19. The apparatus of claim 18, and a second support and second mold inserts to form and finish said object after it is removed from said first support and said first mold inserts.

20. The apparatus of of claim 18, and said press member comprising a porous press member adapted to permit said fluid to exit therethrough during pressing of said met.

21. The apparatus of claim 18, wherein said support comprises a porous metal screen.

22. The apparatus of claim 18, and means for simultaneously holding said press member in place on the compressed mat and on the mold inserts and applying heat thereto, whereby said object is formed using a press drying technique.

23. The apparatus of claim 22, and means for applying said heat at a temperature in the range of about 212° F. to about 400° F.

24. The apparatus of claim 18, and means for moving said support so that production of said wood fiber objects proceeds continuously.

25. The apparatus of claim 18, wherein said fluid is water, and wherein said wood fibers are provided in an amount in the range of about 0.09 to about 1.0 percent of fiber to water.

26. The apparatus of claim 18, and means for pressing said object with a pressure in the range of about 25 to about 100 psi.

27. The apparatus claim 18, and said mold inserts being made of silicone rubber.

28. The apparatus of claim 18, and said object comprising a textured construction panel.

29. The apparatus of claim 18, and said fibers comprising substantially entirely hardwood fibers.

30. The apparatus claim 18, and wherein said webs extend at substantially a right angle to said flat side.

31. The apparatus of claim 18, and means for gluing said mold inserts to said support.

32. The apparatus of claim 18, and means for spacing said mold inserts apart from each other on said support.

33. The apparatus of claim 18, said mold inserts being formed of a membrane of said resilient material, and means for selectively inflating portions of said membrane to form said mold inserts.

34. The apparatus of claim 33, the portions of said membrane which form said mold inserts having sufficient stiffness to hold the shape of said inserts even when they are uninflated.

35. The apparatus of claim 33, and a pattern of securing means to secure said membrane to said support to form a plurality of functionally separate mold inserts from said membrane.

* * * * *

UNITED STATES PATENT AND TRADEMARK OFFICE

CERTIFICATE OF CORRECTION

PATENT NO. : 4,702,870

DATED : October 27, 1987

INVENTOR(S) : Vance C. Setterholm and John F. Hunt

It is certified that error appears in the above-identified patent and that said Letters Patent is hereby corrected as shown below:

In the drawings, Sheet 3, Figure 9: change "19B" to --14B--.
Column 1: line 46, change "abudance" to --abundance--.
Column 3: line 45, change "illustrates" to --illustrate--.
Column 4: line 39, change "form" to --from--; line 60, change "new" to --now--.
Column 5: line 67, change "preferable" to --preferably--.
Column 6: line 57, change "crawing" to --drawing--.
Column 7: line 2, change "assint" to --assist--; line 4, change "14" to --13-- and change "car to" to --can be--; line 22, change "membrances" to --membranes--; line 59, change "invertion" to --invention--.
Claim 1: line 8, change "suppor" to --support--; line 14, insert a --,-- between "differential" and "pressing"; line 18, change "stop" to --step--.
Claim 3: line 2, change "there through" to --therethrough--.
Claim 7: line 3, change "certinuously" to --continuously--.
Claim 17: line 1, change "steps" to --step--; line 2, change "insert" to --inserts--.
Claim 20: line 1, delete one "of"; line 4, change "met" to --mat--.
Claim 27: line 1, insert --of-- between "apparatus" and "claim".
Claim 30: line 1, insert --of-- between "apparatus" and "claim".

Signed and Sealed this

Sixth Day of December, 1988

*Attest:*

DONALD J. QUIGG

*Attesting Officer*

*Commissioner of Patents and Trademarks*